United States Patent [19]

Nauta

[11] 4,145,144

[45] Mar. 20, 1979

[54] WORM MIXER FOR A CONTAINER

[75] Inventor: Constant J. Nauta, Overveen, Netherlands

[73] Assignee: Nautamix Patent AG, Zug, Switzerland

[21] Appl. No.: 726,799

[22] Filed: Sep. 27, 1976

[30] Foreign Application Priority Data

Sep. 30, 1976 [NL] Netherlands ..... 7511535

[51] Int. Cl.[2] ..... B01F 9/22

[52] U.S. Cl. ..... 366/287; 366/311; 366/312

[58] Field of Search ..... 259/111, 102; 366/287, 366/288, 309, 311, 312, 313

[56] References Cited

U.S. PATENT DOCUMENTS

| | | | |
|---|---|---|---|
| 2,645,911 | 7/1953 | Martin | 366/309 |
| 3,249,342 | 5/1966 | Mikkelsen | 259/111 |

FOREIGN PATENT DOCUMENTS

| | | | |
|---|---|---|---|
| 1140441 | 11/1962 | Fed. Rep. of Germany | 259/111 |
| 1397988 | 3/1965 | France | 259/109 |
| 1476494 | 2/1967 | France | 259/108 |
| 624875 | 9/1961 | Italy | 259/111 |
| 107841 | 10/1963 | Netherlands | 259/111 |
| 1274003 | 5/1972 | United Kingdom | 259/175 |

*Primary Examiner*—Robert W. Jenkins
*Attorney, Agent, or Firm*—Wilkinson, Mawhinney & Theibault

[57] ABSTRACT

An improved worm mixer for use in containers having pivotally mounted wires attached to the superficies of the worm and being parallel to the axis of the worm so as to prevent residue from forming on the walls of the container.

13 Claims, 3 Drawing Figures

WORM MIXER FOR A CONTAINER

BACKGROUND OF THE INVENTION

This invention relates to a worm mixer for a container. In such containers all kinds of substances receive treatments, which vary greatly, ranging from mixing pulverulent- and granular materials to pasty substances; such a treatment may be carried out at an increased or decreased temperature or pressure. During such a process the problem may occur that a layer of the treated materials is deposited on the inside wall of the container along which the worm mixer moves. This layer may impair the treatment results and when the treatment has been terminated and the container is cleaned, the layer may be hard to remove.

SUMMARY OF THE INVENTION

The invention aims to overcome this trouble and to provide a worm mixer which reduces the deposit to a minimum, while moreover the process is less influenced by the wall effect.

This is attained according to the invention by the arrangement that at least part of the outer marginal portion of the worm is provided with one or more wires or bands which are secured in the vicinity of the superficies of the worm. These wires or bands cut loose doughy or pasty material clinging to the wall, whereby a smaller propulsion of the material in an upward direction along the wall is attained. Furthermore the cutting edges reduce the dimensions of the deposit on the container wall to a minimum, while the wall effect on the material itself is reduced by the regular severance of the material on the wall from that in the other part of the container, which particularly may be of importance when operating with pasty substances. The cutting edges also have likewise a clod breaking, clod cutting effect, respectively on the material which is elsewhere in the container.

According to an efficient embodiment of the invention the wires or bands extend in an axial direction over at least one length of pitch of the worm.

According to another embodiment of the invention the wires or bands are each mounted on two or more brackets, which are each pivotally connected around pivot axes to the blades of the worm, said pivot axes each extending parallel to the axes of the worm mixer, whereas the brackets have been pivotated eccentrically, the spacing from the pivot axes to the leading edge of the band cross section, that preferentially is somewhat decreasing to this leading edge, being greater than the spacing to the container wall, so that this leading edge can scrape along the container wall. These bands scrape by their leading edges close along the inner wall of the container and limit the thickness of layer of the deposit of hardening substances, so that cleaning the container is considerably simplified and almost the entire contents of the container partakes of the treatment.

The invention is hereinafter clarified with reference to the drawing in which some embodiments are shown.

DETAILED DESCRIPTION OF THE PREFERRED EMBODIMENT

Figure 1:
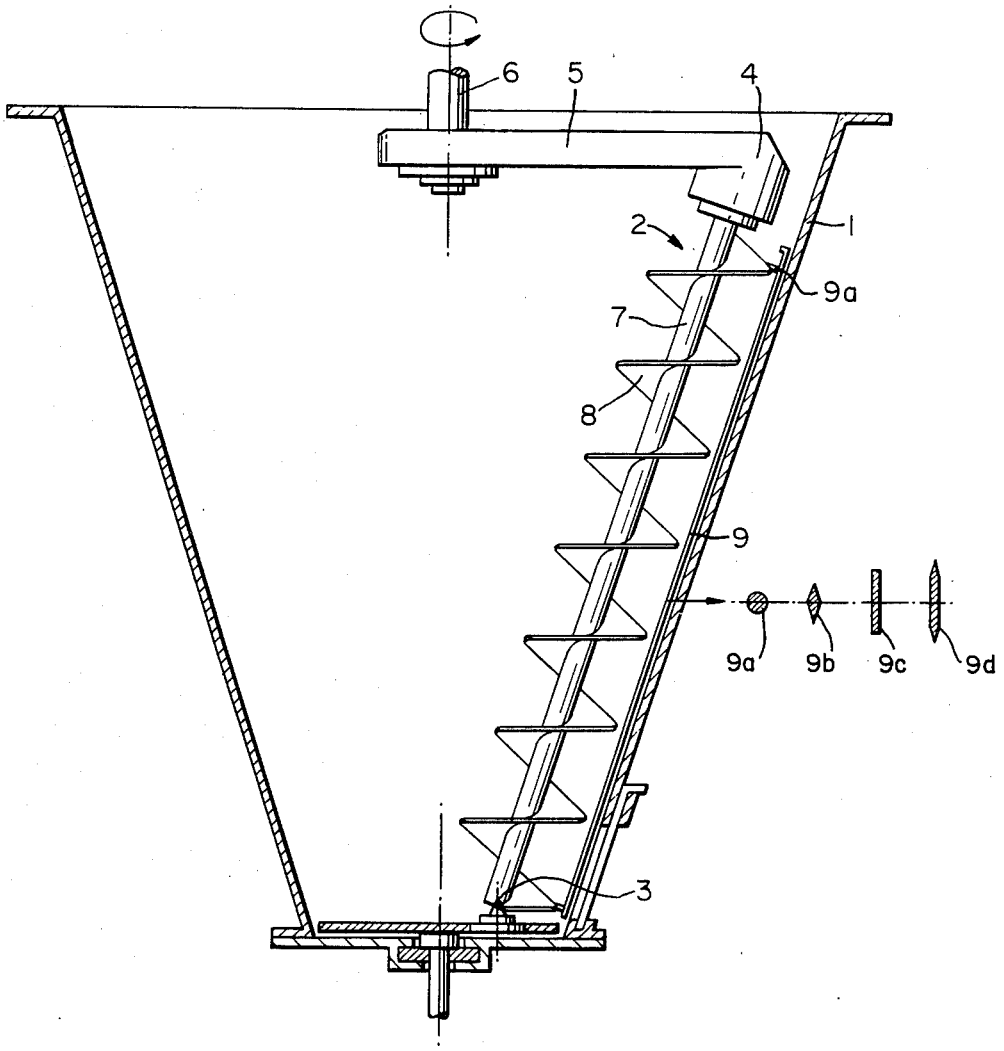
FIG. 1 shows an axial section through a container in which a worm mixer according to a first embodiment of the invention is disposed.

FIG. 1 represents a container 1 which contains a worm mixer 2 extending close along the inner wall of the container 1. The worm mixer is supported at its lower end on a thrust bearing 3 and at its upper end connected with a driving head 4. This head 4 is mounted at the end of an arm 5 which is rotated by a shaft 6 mounted in the centre of the container 1. Yet another separate drive is provided in the driving head 4, so that the worm mixer 2 is rotated around its own axis on the one hand and is rotated by the arm 5 close along the inner wall of the truncated conical vessel on the other hand.

The worm mixer 2 comprises a shaft 7 on which is mounted a helical blade 8. Along the outer edge of the blade and extending on almost the entire axial length thereof is mounted a wire or band 9. This wire or band 9 can have a cross section which is circular as at **9*a*, lozenge-shaped as at 9*b*, rectangular and having blunt edges as at 9*c*, or rectangular with knife edges as at 9*d*, as indicated in outline in FIG. 1. This wire or band 9 is secured, at least at the ends, to the blade 8 and has at least at one end, here at its upper end a tensioning device 9*a*. When pasty or doughy substances are treated in the container 1 the wire 9 has a cutting effect on the material which deposits on the inner wall of the container, whereby the propulsion of this material in an upward direction is considerably reduced and a complete mixing in the container 1** is achieved. When the wire or band is sufficiently slack tensioned it can scrape along the inside of the container.

Figure 2:
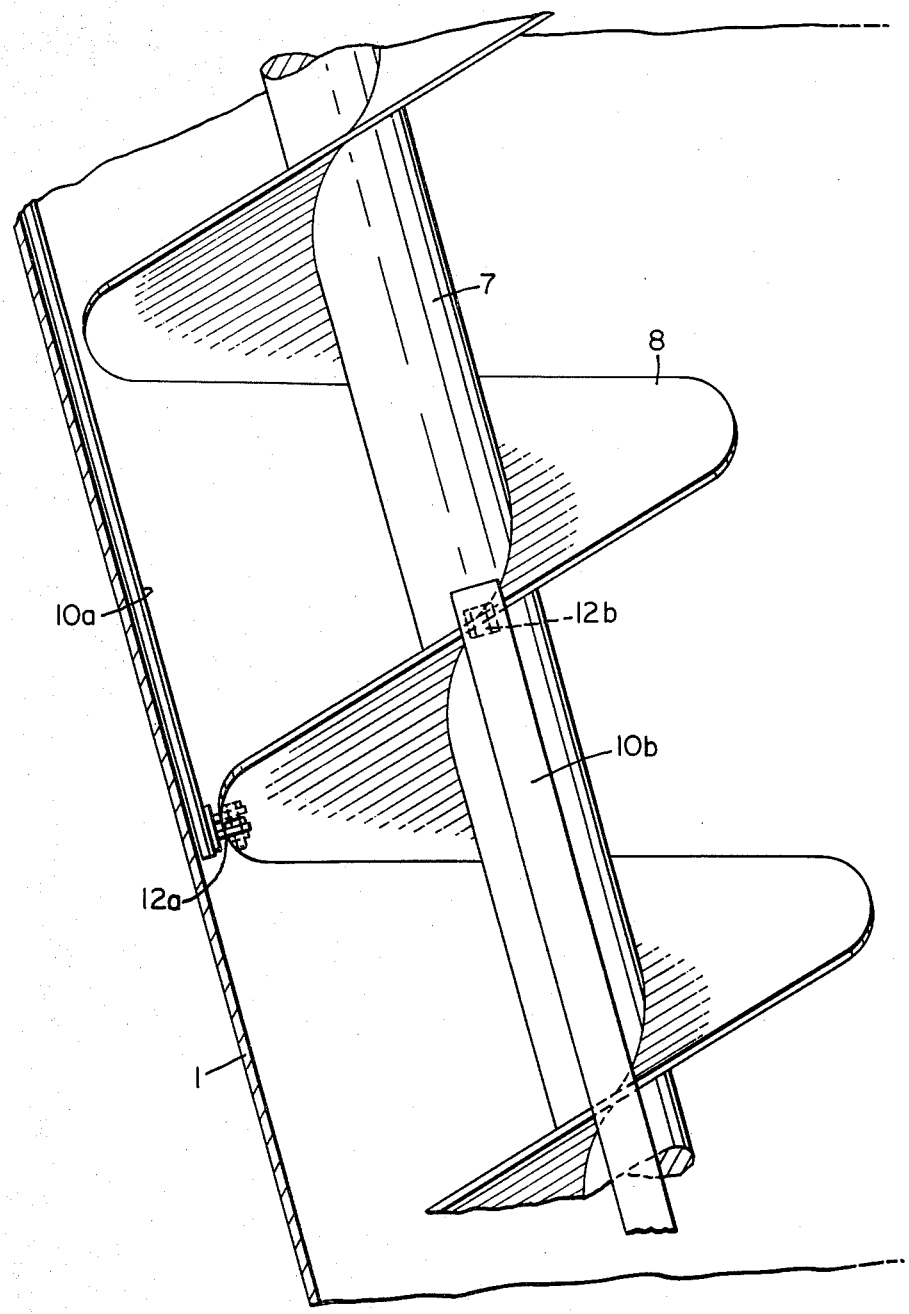
FIG. 2 is a detail on an enlarged scale corresponding to FIG. 1 of a worm mixer according to a second embodiment.
Figure 3:
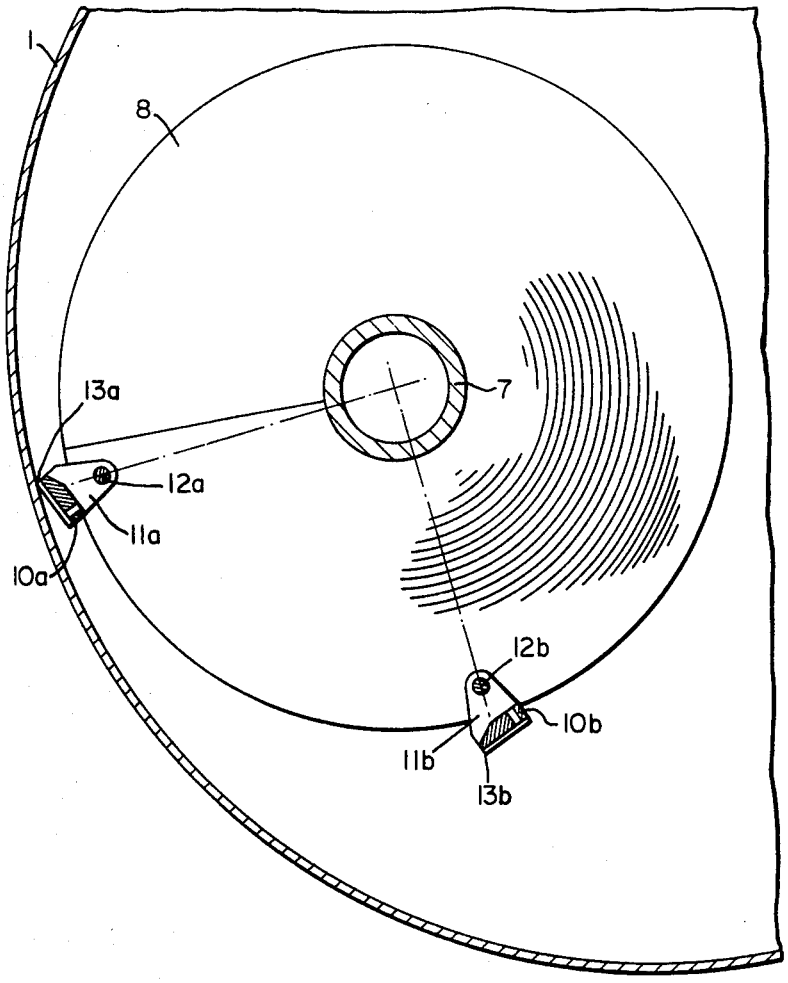
FIG. 3 shows a plan view in axial section through the worm mixer of FIG. 2.

FIGS. 2 and 3 show a second embodiment of the invention.

This comprises wires or bands **10*a*, 10*b* that are each mounted on two or more brackets 11*a*, 11*b*, which are each pivotally connected around pivot axes 12*a*, 12*b* to the blades 8 of the worm 2, said pivot axes 12*a*, 12*b*** each extending parallel to the axis of the worm mixer.

Furthermore, the brackets **11*a*, 11*b* have been pivotated eccentrically, the spacing from the pivot axes 12*a*, 12*b* to the leading edge 13*a*, 13*b* of the band cross section, that preferentially is somewhat decreasing to this leading edge, being greater than the spacing to the container wall 1**, so that this leading edge can scrape along the container wall.

Also, the wires or bands **10*a*, 10*b* are distributed around the circumference of the worm shaft 7**, whereas these wires or bands each extend over a short length of one or more pitch length.

What we claim is:

1. A mixing means for mixing the contents of a container, comprising: a worm mixer having a central shaft and helical blade means disposed therearound, said blade means comprising a plurality of convolutions, the radially outer periphery of said blade means being inwardly spaced from said container; band means disposed substantially parallel to said central shaft and pivotally mounted on and extending radially outwardly of said blade means; said pivotal mounting being adjacent the extremeties of the terminii of said blade means and of said band means, the intermediate portions of said band means being radially spaced from said blade means; means supporting said worm mixer relative to said container; means driving said shaft whereby said band means, in rotation, is caused to approach the inner surface of said container.

2. A mixing means according to claim 1, wherein said means supporting said central shaft comprises an arm extending radially inwardly of the axis of rotation of said central shaft; means driving said arm about said radially inwardly extending end, whereby a compound orbital rotation of said helical blade means and said band means thereon is obtained.

3. A mixing means according to claim 2, wherein the means mounting said band means upon said blade comprises pivoted cam means, whereby upon rotation of said blade, said band is pivotally cammed in a direction toward the inner surface of said container.

4. A mixing means according to claim 3, wherein said band means extends substantially the length of said shaft.

5. A mixing means according to claim 1, wherein said band means comprises more than one element spaced circumferentially about said periphery thereof.

6. A mixing means according to claim 5, wherein said means supporting said central shaft comprises an arm extending radially inwardly of the axis of rotation of said central shaft; means driving said arm about said radially inwardly extending end, whereby a compound orbital rotation of said helical blade means and said band means thereon is obtained.

7. A mixing means according to claim 6, wherein said band means extends substantially the length of said shaft.

8. A mixing means according to claim 1, wherein said band means is of a substantially circular configuration.

9. A mixing means according to claim 1, wherein said band means is of a substantially lozenge-shaped configuration.

10. A mixing means according to claim 1, wherein said band means is of a substantially rectangular configuration.

11. A mixing means according to claim 10, wherein the edges of said rectangular configuration are knife edged.

12. A mixing means for mixing the contents of a container, comprising: a worm mixer having a central shaft and helical blade means disposed therearound, the radially outer periphery of said blade means being inwardly spaced from said container; band means disposed substantially parallel to said central shaft and pivotally mounted on and extending radially outwardly of said blade means; said pivotal mounting being adjacent the extremeties of said blade means; means supporting said worm mixer relative to said container; means driving said shaft whereby said band means, in rotation, is caused to approach the inner surface of said container; wherein the means mounting said band means upon said blade comprises pivoted cam means, whereby upon rotation of said blade, said band is pivotally cammed in a direction toward the inner surface of said container; wherein said means mounting said band means further comprises means for varying the tension on said band means.

13. A mixing means for mixing the contents of a container, comprising: a worm mixer having a central shaft and helical blade means disposed therearound, the radially outer periphery of said blade means being inwardly spaced from said container; band means disposed substantially parallel to said central shaft and pivotally mounted on and extending radially outwardly of said blade means; said pivotal mounting being adjacent the extremeies of said blade means; means supporting said worm mixer relative to said container; means driving said shaft whereby said band means, in rotation, is caused to approach the inner surface of said container; wherein said band means comprises more than one element spaced circumferentially about said periphery thereof; wherein said means mounting said band further comprises means for varying the tension on said band means.

* * * * *